US009067770B1

(12) United States Patent
Sharp

(10) Patent No.: US 9,067,770 B1
(45) Date of Patent: Jun. 30, 2015

(54) GAS POWERED LIFT

(71) Applicant: Mark Perry Sharp, Old Hickory, TN (US)

(72) Inventor: Mark Perry Sharp, Old Hickory, TN (US)

(73) Assignee: MARK PERRY SHARP, Old Hickory, TN (US)

( * ) Notice: Subject to any disclaimer, the term of this patent is extended or adjusted under 35 U.S.C. 154(b) by 386 days.

(21) Appl. No.: 13/694,241

(22) Filed: Nov. 13, 2012

(51) Int. Cl.

| | |
|---|---|
| ***B66F 3/35*** | (2006.01) |
| ***B66F 3/24*** | (2006.01) |
| ***B66F 3/22*** | (2006.01) |
| ***B66F 3/00*** | (2006.01) |
| ***B66F 5/04*** | (2006.01) |
| ***B65D 85/00*** | (2006.01) |
| *B66F 7/06* | (2006.01) |
| *B66F 7/08* | (2006.01) |

(52) U.S. Cl.
CPC . *B66F 5/04* (2013.01); *B65D 85/70* (2013.01); *B66F 7/065* (2013.01); *B66F 7/085* (2013.01); *B66F 7/0625* (2013.01)

(58) Field of Classification Search
CPC ..... B60P 1/02; B66F 7/0265; B66F 7/065; B66F 7/0633; B66F 7/22; B66F 7/08; B66F 7/0683; B66F 7/085
USPC ... 254/2 R, 1, 122, 126, 8 B, 2 C, 9 C, 93 HP, 254/10 C, 10 R, 10 B, 93 R; 383/44
See application file for complete search history.

(56) References Cited

U.S. PATENT DOCUMENTS

| | | | | |
|---|---|---|---|---|
| 3,174,722 | A * | 3/1965 | Alm | 254/93 HP |
| 5,419,534 | A * | 5/1995 | Vesely | 254/9 C |
| 5,542,806 | A * | 8/1996 | Kang | 254/93 HP |
| 5,771,816 | A * | 6/1998 | Zaguroli, Jr. | 108/147 |
| 6,286,812 | B1 * | 9/2001 | Cherry | 254/9 C |
| 7,070,167 | B1 * | 7/2006 | Bacon et al. | 254/93 HP |
| 2002/0174486 | A1 * | 11/2002 | Heuvel et al. | 5/611 |
| 2009/0278098 | A1 * | 11/2009 | Bacon | 254/1 |

* cited by examiner

*Primary Examiner* — Lee D Wilson
*Assistant Examiner* — Seahee Yoon

(57) ABSTRACT

A portable compressed gas powered lift, said lift possessing an inner and outer frame of a scissor design. The frame possesses rollers, allowing said frame to roll on a surface. Compressed flexible gas bags are mounted to upper and lower gas bag mounting plates, which are correspondingly mounted to the scissor frame. A lifting bar with adjustable lifting arms is mounted to the top of the scissor frame. As a compressed gas is introduced into the flexible gas bags the flexible gas bags expand causing the scissor frame to expand and lift vertically. The compressed gas is controlled by a flexible line, from the flexible gas bags, to a compressed gas control valve, said valve being mounted to a Tee handle.

8 Claims, 3 Drawing Sheets

Side View

Oblique view

END VIEW

GAS POWERED LIFT

CROSS-REFERENCE TO RELATED APPLICATIONS

Not Applicable

FEDERALLY SPONSER RESEARCH

Not Applicable

SEQUENCE LISTING OR PROGRAM

Not Applicable

BACKGROUND-FIELD OF INVENTION

This invention relates to gas power lifts, specifically gas bag inflated portable lifts.

BACKGROUND-PRIOR ART

Equipment repair facilities are required to lift objects such as autos, construction equipment, and farm equipment as examples. Many times this equipment must be elevated or lifted to perform this work. Rail-Mounted Vehicle Jack, U.S. Pat. No. 4,323,141, Lifting System For A Vehicle Axle, U.S. Pat. No. 7,396,028 B2, Vehicle Scissor Lift, U.S. Pat. No. 4,899,987, Semi-Scissor Lifts, Publication # US 2011/0309316 A1 are used in this service. These types of lifts are very heavy, permanently mounted, take up large areas of space, and are driven by an oil filled hydraulic pump and cylinder arrangement.

The hydraulic system operates at high pressure, usually above 1000 PSI, posing danger to service personnel. The pump and cylinder are prone to leakage of the high pressure oil, and the pump and cylinder are difficult to repair. Electricity is also required to operate the hydraulic power unit.

Flexible Air Bags exists but are of limited usage in lifting applications due to the bag's physical design. The only way to increase the lifting height of an air bag is to increase the air bag's sidewall dimension. A short Air Bag, while stable under load has a limited lifting height. A taller Air Bag, while capable of higher lifting heights, is inherently unstable due to the flexible nature of the air bag's sidewalls.

The problems solved by the applied for patent design are multiple. Combining the stability of a short Gas Bag, incorporated in the body of a scissor frame, high lifting heights can be achieved. The use of a Gas Bag filled with compressed gas eliminates the hydraulic pump and motor, hydraulic cylinders, hoses, controls, high pressure oil, and electricity required to operate the hydraulic system. Corresponding weight from above components is eliminated, allowing the lift to be portable via attached wheels.

SUMMARY

A portable scissor lift, powered by compressed gas filled Gas Bags, is capable of high lifts with great stability.

DRAWINGS-FIGURES

In the drawings, closely related figures have the same number but different alphabetic suffixes.

Figure 1:
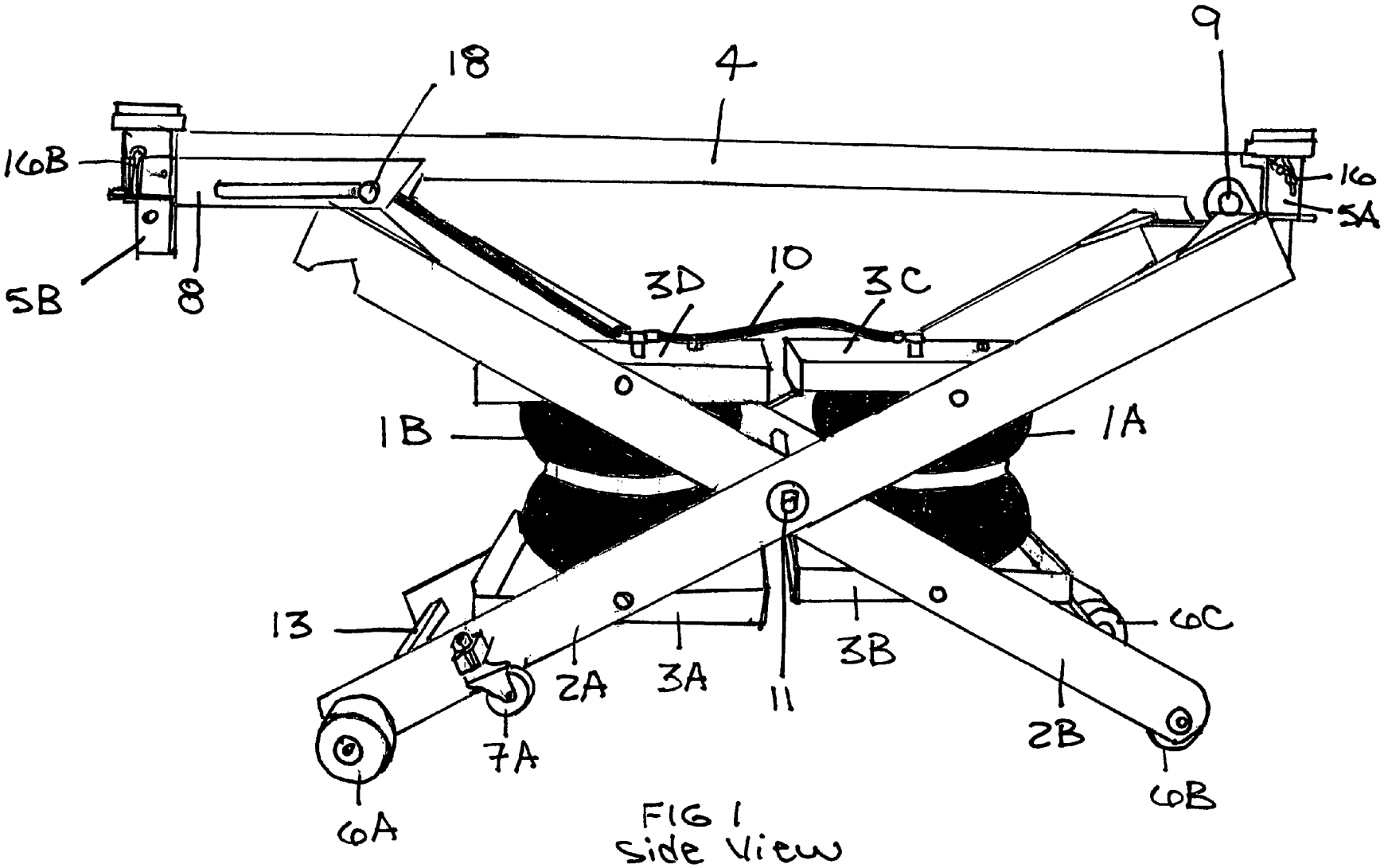
FIG. 1 shows a side view of Gas Power Lift in an extended position with the gas bags inflated.

1A and 1B show the physical gas bag composed of a non-metallic bladder with solid end caps
2A and 2B show the outer scissor frame (2A) and inner scissor frame (2B) composed of metal
2A1 shows a top plate
3A to 3D show the upper and lower mounting plate for the gas bags
4 shows the center lift bar
5A and 5B show the vertically adjustable lift legs
6A to 6D show the main frame wheels
7A and 7B show the wheels
8 shows the center lift bar slide
9 shows the center lift bar pin
10 shows the gas bag fill lines
11 shows the main frame shaft
12A and 12B show internal sliding support arms
13A and 13B show main frame wheel shafts and tubes
14 shows Tee handle
15 shows main gas fill valve and handle
16A and 16B show vertically adjustable lift leg pins
17 shows handle attachment point to scissor frame
18 slide pin

DETAILED DESCRIPTION

Figure 2:
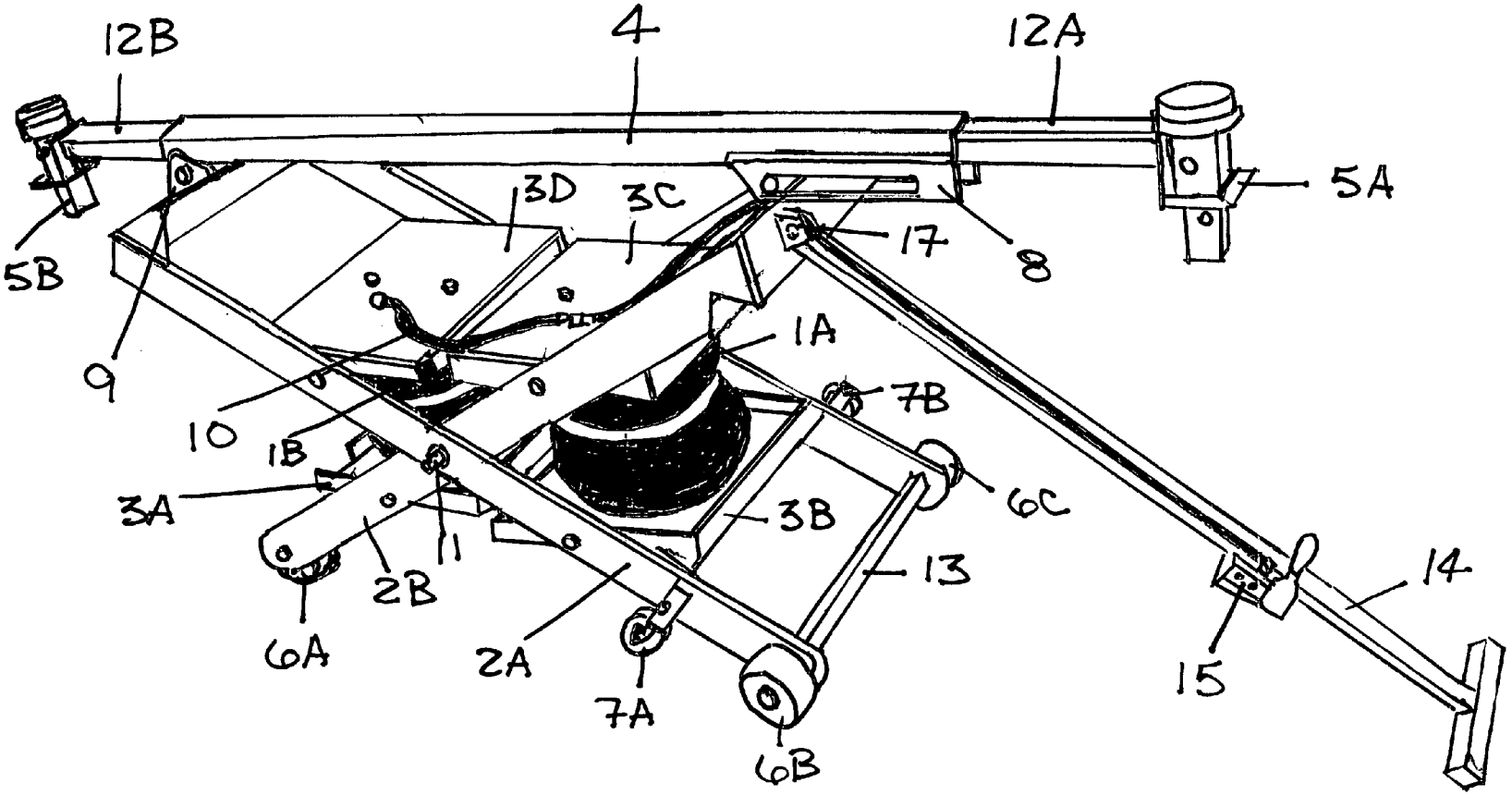
FIG. 2 shows an oblique view of the Gas Powered Lift in an extended position with the gas bags inflated, tee handle with gas devise attached and lifting arms extended.
Figure 3:
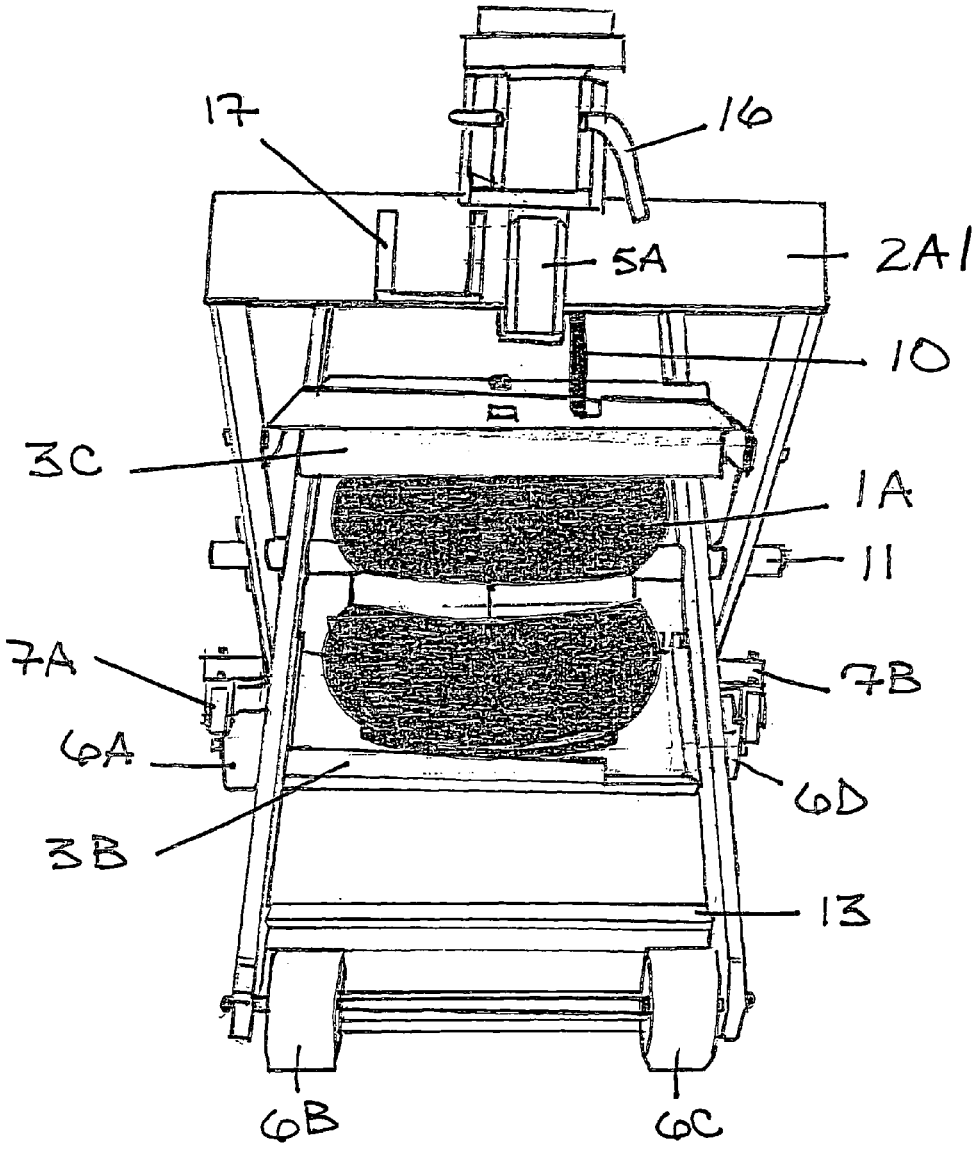
FIG. 3 shows an end view with of Gas Powered Lift in an extended position.

FIG. 1 Side View, FIG. 2 Oblique View and FIG. 3 End View

One embodiment of the gas powered lift is illustrated in FIG. 1 (side view), FIG. 2 (oblique view) and FIG. 3 (end view).

1A and 1B are the physical gas bags composed of rubber, natural rubber, or synthetic material and attached to Upper and Lower mounting plates 3A through 3D. 2A is the Outer Frame while 2B is the Inner Frame resulting in a scissor arrangement and connected via 11 Main Shaft. Mounting plates 3A through 3D are attached to frames 2A and 2B in an alternating pattern allowing the Frame 2A and 2B to scissor. Number 4 is the center lift bar and is attached to Frame 2A at 9 Center Lift bar Pin at one end and attached to Frame 2B at 8 Center Lift Bar Slide at the other end. Number 5A and 5B are vertically adjustable lift legs, mounted to 4 Center Lift Bar. Number 6B and 6C are wheels mounted to Inner Frame 2B. Number 6A and 6D wheels are mounted to outer frame 2A. Number 7A and 7B are wheels mounted to Outer Frame 2A. Number 10 denotes the compressed gas flexible fill lines connected on one end to the gas bags via fittings and terminating at 15 Main Gas Fill Valve.

Number 12A and 12B shown the Internal Sliding Support Arms which fit inside of 44 Center Lift Bar-. Number 13A and 13B are the frame wheel shaft tubes and enclose wheel shafts for 6A through 6D. Number 14 displays the Tee handle connected to 2A1 a top plate of 2A Outer frame at 17 attachment point.

Number 14 displays the Tee handle connected to 2A Outer frame at 17 attachment point. Number 15 contains the gas control valve for the gas bags attached to said Tee Handle 14. Number 16A and 16B are clevis pins which position 5A and 5B Vertical Adjustable Lift Legs.

Operation FIGS. 1, 2 and 3

The gas powered lift initially rests in a collapsed position with the 1A and 1B gas bags empty. The 2A outer and 2B inner scissor frames are nested and provide a minimum height. The unit is designed to be rolled on 7A and 7B roller wheels and 6A to 6D frame rollers for rough positioning under the object to be lifted. The 4 center lift bar is positioned by sliding 12A and 12B sliding arms horizontally in or out, adjustments to the lift points are made. Vertical adjustments are made by adjusting 5A and 5B adjustable lift legs up or down and locked into position with 16A and 16B pins. A compressed gas line is attached to 15 gas valve. By manipulation of the 15 gas valve handle, gas flows through the 15 valve down the 10 compressed gas fill lines and into the 1A and 1B air bags. The 1A and 1B gas bags begin to fill with gas and expand, forcing apart the 3A to 3D air bag mounting plates. Numbers 3A to 3D gas bag mounting plates in turn act upon 2A and 2B frames causing said frames to scissor and elevate 4 center lift bar. Number 8 slide bar allows the 2A inner frame to elevate while 9 pin joint contains 2A outer frame. Contact with the object to be lifted is established. As more gas is introduced into the 1A and 1B gas bags the frame continues to scissor and rise elevating the object to be lifted.

Advantages

From the description above, a number of advantages of some embodiments of my gas powered lift become evident.

(a) The Gas Powered lift is portable and creates a minimum footprint verses current two post, four post and scissor lifts that are permanently mounted, are very heavy and take up large amounts of floor space.

(b) The Gas Powered Lift, being filled with a simple gas, eliminates a hydraulic motor, hydraulic pump, hydraulic fluid storage tank, hydraulic cylinders and controls, all of which are prone to leakage and are difficult to repair.

(c) As the Gas Powered Lift is filled with inert gas at low pressure, the hydraulic system, operating in excess of 1000 PSI and the corresponding electricity to operate the hydraulic system are safely eliminated.

CONCLUSION, RAMIFICATION, AND SCOPE

As can be seen the above embodiment solves a number of lifting problems.

The frame is designed with rollers making the gas powered lift portable and easy to maneuver, thus solving the current issues of immobility of stationary air bag lifting tables. The frame is designed to use a scissor action. By using this scissor configuration, a short stable low pressure gas bag may be used, eliminating an oil based high pressure hydraulic system with corresponding electric pump, motor and hydraulic cylinder. The configuration of a short stable gas bag, capable of lifting great weight, in conjunction with a scissor frame, capable of extended extension elevation, allows heavy objects to be raised to great heights.

Although the description above contains many specificities, these should not be construed as a limiting the scope of the embodiment but merely as providing illustrations of some of the presently preferred embodiments. Thus the scope of the embodiment should be determined by the appended claims and their legal equivalents, rather than by the examples given.

I claim:

1. A lifting device comprising:

a support comprising a center lift bar engaging with internal sliding support arms with at least one transverse adjustable lift leg extending in a vertical direction with respect to said center lift bar;

a frame including a scissor arrangement comprising scissor frames including an inner scissor frame and an outer scissor frame with a top plate, wherein said inner and outer scissor frames are pivotably connected to each other and at least one of the said inner and outer scissor frames is pivotably connected to said support;

at least one gas bag being connected to said frame including at least one mounting plate;

a handle including an elongated member having one end being attached to the top plate at an attachment point and a transverse section at an opposite end of said elongated member;

a controller attached to said elongated member; and a gas bag fill line connected to said controller;

wherein when said at least one gas bag is empty, the lifting device rests in a collapsed position and said inner and outer scissor frames are nested and provide a minimum height.

2. The lifting device according to claim 1, wherein said at least one transverse adjustable lift leg has a plurality of apertures allowing adjustability.

3. The lifting device according to claim 2, further comprising at least one clevis pin for locking said at least transverse adjustable lift leg into position.

4. The lifting device according to claim 1, wherein said scissor frames having a plurality of main frame wheels on an end opposite said support and a pair of wheels mounted on said outer scissor frame inbetween said plurality of main frame wheels and said top plate.

5. The lifting device according to claim 1, wherein said at least one mounting plate includes an upper mounting plate and a lower mounting plate.

6. The lifting device according to claim 1, wherein said at least one gas bag includes a second gas bag and said at least one mounting plate includes a second mounting plate.

7. The lifting device according to claim 6, wherein each of said at least one mounting plate and said second mounting plate includes an upper mounting plate and a lower mounting plate.

8. The lifting device according to claim 1, wherein said center lift bar includes a slide bar with a slot which allows an adjustment of at least one of said outer and inner scissor frames by a slide pin within said slot.

* * * * *